US010571174B2

(12) United States Patent
Hern et al.

(10) Patent No.: US 10,571,174 B2
(45) Date of Patent: Feb. 25, 2020

(54) SYSTEMS AND METHODS FOR DEFROST CONTROL

(71) Applicant: Johnson Controls Technology Company, Plymouth, MI (US)

(72) Inventors: Shawn A. Hern, Park City, KS (US); Brian D. Rigg, Douglass, KS (US); Elton D. Ray, Wichita, KS (US); Jedidiah O. Bentz, Witchita, KS (US); Theresa N. Gillette, Wichita, KS (US); Tom R. Tasker, Andover, KS (US); Shaun B. Atchison, Wichita, KS (US); Tyler McCune, El Dorado, KS (US); Aneek M. Noor, Wichita, KS (US)

(73) Assignee: Johnson Controls Technology Company, Auburn Hills, MI (US)

( * ) Notice: Subject to any disclaimer, the term of this patent is extended or adjusted under 35 U.S.C. 154(b) by 404 days.

(21) Appl. No.: 15/417,182

(22) Filed: Jan. 26, 2017

(65) Prior Publication Data

US 2018/0031289 A1 Feb. 1, 2018

Related U.S. Application Data

(60) Provisional application No. 62/421,201, filed on Nov. 11, 2016, provisional application No. 62/367,561, (Continued)

(51) Int. Cl.
*F25B 47/02* (2006.01)

(52) U.S. Cl.
CPC ..... *F25B 47/025* (2013.01); *F25B 2500/19* (2013.01); *F25B 2600/2513* (2013.01); *F25B 2700/171* (2013.01)

(58) Field of Classification Search
CPC .... F25B 2700/21151; F25B 2700/2103; F25B 2700/11; F25B 2700/2106; F25B 2600/23;
(Continued)

(56) References Cited

U.S. PATENT DOCUMENTS 4,328,680 A * 5/1982 Stamp, Jr. ..... F25D 21/006 62/155
4,563,877 A * 1/1986 Harnish ..... F25D 21/002 62/156

(Continued)

OTHER PUBLICATIONS

U.S. Appl. No. 14/155,575, filed Jan. 15, 2014, Emerson Electric Co.

*Primary Examiner* — Kun Kai Ma
(74) *Attorney, Agent, or Firm* — Foley & Lardner LLP

(57) ABSTRACT

A system for heating a building via refrigerant includes a coil temperature sensor, an ambient temperature sensor, and a controller. The controller includes a processing circuit configured to record a system operating parameter and a control step of a control process before performing a sacrificial defrost cycle. The processing circuit is configured to cause the system to perform the sacrificial defrost cycle and operate the system at predefined system operating parameters other than the recorded system operating parameters. The system is configured to cause the system to operate at the recorded system operating parameters and generate calibration data in response to the sacrificial defrost cycle ending. The processing circuit is configured to cause the control process to operate at the recorded control step and cause the system to perform a defrost cycle based on the calibration data, the coil temperature, and the ambient temperature.

20 Claims, 4 Drawing Sheets

Related U.S. Application Data filed on Jul. 27, 2016, provisional application No. 62/367,357, filed on Jul. 27, 2016.

(58) Field of Classification Search
CPC ..... F25B 2700/171; F25B 2700/1933; F25B 2700/1931; F25B 2500/19
See application file for complete search history.

(56) References Cited

U.S. PATENT DOCUMENTS 4,573,326 A * 3/1986 Sulfstede ..... F25D 21/006 62/128
4,590,771 A * 5/1986 Shaffer ..... F25D 21/006 62/155
4,653,285 A * 3/1987 Pohl ..... F25D 21/006 318/729
4,724,678 A * 2/1988 Pohl ..... F25D 21/006 62/140
4,751,825 A * 6/1988 Voorhis ..... F25D 21/006 62/155
4,882,908 A * 11/1989 White ..... F25B 13/00 62/155
4,884,414 A * 12/1989 Bos ..... F25D 21/006 62/156
5,319,943 A * 6/1994 Bahel ..... F24F 1/0003 62/156
5,410,230 A * 4/1995 Bessler ..... H02P 6/085 318/471
5,469,715 A * 11/1995 Janke ..... F25D 21/002 62/155
5,490,556 A * 2/1996 Pichotta ..... B60H 1/00828 165/255
5,507,154 A * 4/1996 Grant ..... F25D 21/006 62/151
5,511,724 A * 4/1996 Freiberger ..... B60H 1/00735 236/49.3
5,515,689 A * 5/1996 Atterbury ..... F25D 21/006 62/155
5,765,382 A * 6/1998 Manning ..... F25D 21/006 62/154
6,318,095 B1 11/2001 Guo et al.
6,976,366 B2 12/2005 Starling et al.
8,417,386 B2 * 4/2013 Douglas ..... F25B 47/02 700/276
8,783,048 B2 7/2014 Edens et al.
10,041,721 B2 * 8/2018 Qu ..... F25D 21/008
2015/0362207 A1 * 12/2015 Abiprojo ..... F24F 11/30 702/183
2016/0169571 A1 * 6/2016 Kimura ..... F25B 47/025 62/155
2017/0082308 A1 * 3/2017 Gokhale ..... F25B 47/006
2018/0164019 A1 * 6/2018 Langenberg ..... F25D 21/006

* cited by examiner

SYSTEMS AND METHODS FOR DEFROST CONTROL

CROSS-REFERENCE TO RELATED PATENT APPLICATION

This application claims the benefit of and priority to U.S. Provisional Patent Application No. 62/367,357 filed Jul. 27, 2016 and U.S. Provisional Patent Application No. 62/367,561 filed Jul. 27, 2016. The entire disclosure of each of these patent applications is incorporated by reference herein. This application further claims the benefit of and priority to U.S. Provisional Patent Application No. 62/421,201 filed Nov. 11, 2016.

BACKGROUND

Heat pumps, which operate during winter months, require a method for removing frost that accumulates on an outdoor coil of the heat pump while the heat pump heats a building. The heat pump may be configured to operate a reversing valve to change refrigerant flow from a heating cycle, used to heat the building, to a cooling cycle, used to heat the outdoor coil and thus remove any frost which has accumulated on the outdoor coil.

SUMMARY

One implementation of the present disclosure is a system for heating a building via refrigerant. The system includes a coil temperature sensor configured to measure a coil temperature of an outdoor coil and an ambient temperature sensor configured to measure an outdoor ambient temperature. The system further includes a controller that includes a processing circuit. The processing circuit is configured to record a system operating parameter indicating the current operating status of the system and a control step of a control process before performing a sacrificial defrost cycle. The system operating parameter includes a speed of a compressor. The processing circuit is configured to cause the system to perform the sacrificial defrost cycle and operate the system at predefined system operating parameters other than the recorded system operating parameters. The processing circuit is configured to cause the system to operate at the recorded system operating parameters and generate calibration data in response to the sacrificial defrost cycle ending. The processing circuit generates the calibration data by recording the coil temperature and the ambient temperature. The processing circuit is configured to cause the control process to operate at the recorded control step and cause the system to perform a defrost cycle based on the calibration data, the coil temperature, and the ambient temperature.

In some embodiments, the processing circuit is configured to perform another sacrificial defrost cycle in response to determining that the coil temperature is below a predefined amount during the sacrificial defrost cycle.

In some embodiments, the processing circuit is configured to cause the system to perform the defrost cycle based on the calibration data, the coil temperature, and the ambient temperature a predefined amount of time after the sacrificial defrost in response to determining that the coil temperature is above a predefined amount during the sacrificial defrost cycle.

In some embodiments, the processing circuit is configured to cause the system to perform the defrost cycle based on the calibration data, the coil temperature, and the ambient temperature in response to a predefined amount of time elapsing after the sacrificial defrost cycle in which the coil temperature is below a predefined amount.

In some embodiments, the calibration data includes the recorded ambient temperature and the difference between the recorded ambient temperature and the recorded coil temperature.

In some embodiments, the processing circuit is configured to determine a frost free curve (FFC) based on the recorded ambient temperature, the difference between the recorded ambient temperature and the recorded coil temperature, and a current ambient temperature measured by the ambient temperature sensor.

In some embodiments, the processing circuit is configured to determine a defrost active variable (DAV) based on a temperature dependent variable (TDV) and the FFC. The TDV may be dependent on the coil temperature and perform the defrost in response to determining that a difference between a current ambient temperature and a current coil temperature is greater than the DAV. The current ambient temperature may be measured by the ambient temperature sensor and the current coil temperature is measured by the coil temperature sensor.

In some embodiments, the processing circuit is configured to determine the TDV based on the coil temperature and one or more relationships. Each relationship relates to a range of coil temperatures.

In some embodiments, the processing circuit causes the system to perform the sacrificial defrost in response to a predefined amount of time elapsing while the coil temperature is below a predefined level.

In some embodiments, the processing circuit is configured to cause the system to perform the defrost cycle after a predefined amount of time in which no defrost cycle is performed.

Another implementation of the present disclosure is a method for defrosting an outdoor coil of a heating system. The method includes measuring a coil temperature via a coil temperature sensor and measuring an ambient temperature via an ambient temperature sensor. The method further includes recording a speed of a compressor, a setpoint of an electronic expansion valve, and a control step of a control process before performing a sacrificial defrost cycle. The method further includes performing the sacrificial defrost cycle and operating the heating system at a predefined electronic expansion valve setpoint and a predefined compressor speed other than the recorded compressor speed and the recorded electronic expansion valve position. The method further includes causing the heating system to operate at the recorded compressor speed and the recorded electronic expansion valve setpoint in response to the sacrificial defrost cycle ending. The method further includes generating calibration data based on the coil temperature and the ambient temperature. Generating the calibration data includes recording the coil temperature and recording the ambient temperature. The method includes causing the control process to operate at the recorded control process step in response to the sacrificial defrost cycle ending and causing the heating system to perform a defrost cycle based on the calibration data, the coil temperature, and the ambient temperature.

In some embodiments, the method includes performing another sacrificial defrost cycle in response to determining that the coil temperature is below a predefined amount during the sacrificial defrost cycle.

In some embodiments, the method includes causing the system to perform the defrost cycle based on the calibration data, the coil temperature, and the ambient temperature a predefined amount of time after the sacrificial defrost in response to determining that the coil temperature is above a predefined amount during the sacrificial defrost cycle.

In some embodiments, the method includes causing the system to perform the defrost cycle based on the calibration data, the coil temperature, and the ambient temperature in response to a predefined amount of time elapsing in which the coil temperature is below a predefined amount.

In some embodiments, the calibration data includes the difference between the recorded ambient temperature and the recorded coil temperature.

In some embodiments, the method includes determining a defrost active variable (DAV) based on a temperature dependent variable (TDV) and a frost free curve (FFC) and causing the heating system to perform the defrost cycle in response to determining that a difference between a current ambient temperature and a current coil temperature is greater than the DAV.

The method may further include determining the FFC based on the recorded ambient temperature, the difference between the recorded ambient temperature and the coil temperature, and the current ambient temperature.

In some embodiments, the method further includes determining the TDV based on the coil temperature and one or more relationships. Each relationship may relate to a range of coil temperatures.

Another implementation of the present disclosure is a controller for a heating system configured to heat a building via refrigerant. The controller includes a coil temperature sensor configured to measure a coil temperature of an outdoor coil and an ambient temperature sensor configured to measure an ambient temperature. The controller further includes a processing circuit. The processing circuit is configured to record a speed of a compressor, a setpoint of an electronic expansion valve, and a control step of a control process before performing a sacrificial defrost cycle. The processing circuit is further configured to cause the system to perform the sacrificial defrost cycle and cause the heating system to operate at a predefined compressor speed and a predefined electronic expansion valve setpoint other than the recorded compressor speed and the recorded electronic expansion valve setpoint. The processing circuit is configured to cause the heating system to operate at the recorded compressor speed and the recorded electronic expansion valve setpoint in response to the sacrificial defrost cycle ending. The processing circuit is configured to cause the control process to operate at the recorded control process step in response to the sacrificial defrost cycle ending. The processing circuit is further configured to determine a temperature dependent variable (TDV) based on the coil temperature and one or more relationships between the TDV and the coil temperature. Each relationship may relate to a range of coil temperatures. The processing circuit is further configured to determine a frost free curve (FFC) based on the recorded ambient temperature, the difference between the recorded ambient temperature and the recorded coil temperature, and the ambient temperature. Further, the processing circuit is configured to determine a defrost active variable (DAV) based on the TDV and the FFC and cause the heating system to perform a defrost cycle in response to determining that a difference between a current ambient temperature and a current coil temperature is greater than the DAV.

In some embodiments, the processing circuit is configured to cause the heating system to perform another sacrificial defrost cycle in response to determining that the coil temperature is below a predefined amount during the sacrificial defrost cycle.

BRIEF DESCRIPTION OF THE DRAWINGS

Various objects, aspects, features, and advantages of the disclosure will become more apparent and better understood by referring to the detailed description taken in conjunction with the accompanying drawings, in which like reference characters identify corresponding elements throughout. In the drawings, like reference numbers generally indicate identical, functionally similar, and/or structurally similar elements.

DETAILED DESCRIPTION

Referring generally to the FIGURES, systems and methods for determining an ideal time to operate a defrost cycle are shown, according to various exemplary embodiments. In some embodiments, a controller of an outdoor unit (e.g., a heat pump and/or air conditioner) may monitor a temperature of an outdoor coil and outdoor ambient air to determine when to initiate a defrost cycle. In various embodiments, the outdoor controller uses the outdoor ambient air temperature, the outdoor coil temperature, and calibration data to determine when to initiate a defrost cycle.

The calibration data used by the controller to determine when to initiate a defrost cycle may be generated whenever the controller is in an uncalibrated state (e.g., has just been power cycled, has just received a heating call, a heating call has been met before performing a calibration cycle, etc.). To generate the calibration data, the controller may first prepare the outdoor coil by performing a defrost cycle referred to as a "sacrificial defrost." The sacrificial defrost may last a predefined amount of time (e.g., 12 minutes). The sacrificial defrost may be performed to ensure that there is no frost accumulated on the outdoor coil. The controller can be configured to generate the calibration data once it is confirmed via coil temperature that the sacrificial defrost has removed any frost accumulation.

Once the calibration data has been generated, the controller can monitor the coil temperature and the ambient temperature and use the monitored temperatures in combination with the calibration data to initiate a defrost cycle. In some embodiments, the controller only monitors the temperatures after the coil temperature has been below a predefined amount for a predefined amount of time. The timer responsible for determining this time may be referred to as a defrost run timer. The defrost run timer may record defrost run time only when the temperature is below the predefined amount. Once the defrost run time equals the predefined amount, the controller may begin to monitor the coil temperature, and the ambient temperature to determine when to begin the defrost cycle.

Systems And Methods

Figure 1:
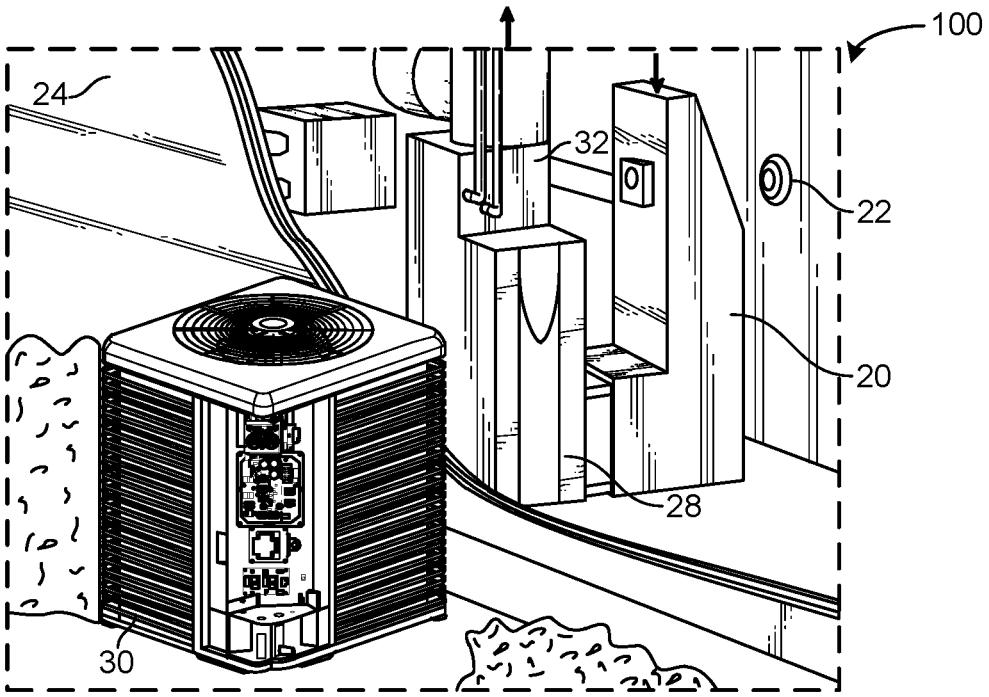
FIG. 1 is a schematic drawing of a building equipped with a residential heating and cooling system, according to an exemplary embodiment.

FIG. 1 illustrates a residential heating and cooling system 100. The residential heating and cooling system may provide heated and cooled air to a residential structure, as well as provide outside air for ventilation and provide improved indoor air quality (IAQ) through devices such as ultraviolet lights and air filters. Although described as a residential heating and cooling system, embodiments of the systems and methods described herein can be utilized in a cooling unit or a heating unit in a variety of applications include commercial HVAC units (e.g., roof top units). In general, a residence 24 includes refrigerant conduits that operatively couple an indoor unit 28 to an outdoor unit 30. Indoor unit 28 may be positioned in a utility space, an attic, a basement, and so forth. Outdoor unit 30 is situated adjacent to a side of residence 24 in some embodiments and is covered by a shroud or housing to protect the system components and to prevent leaves and other contaminants from entering the unit. Refrigerant conduits transfer refrigerant between indoor unit 28 and outdoor unit 30, typically transferring primarily liquid refrigerant in one direction and primarily vaporized refrigerant in an opposite direction.

When the system shown in FIG. 1 is operating as an air conditioner, a coil in outdoor unit 30 serves as a condenser for recondensing vaporized refrigerant flowing from indoor unit 28 to outdoor unit 30 via one of the refrigerant conduits. In these applications, a coil of the indoor unit, designated by the reference numeral 32, serves as an evaporator coil. Indoor coil 32 receives liquid refrigerant (which may be expanded by an expansion device, not shown) and evaporates the refrigerant before returning it to outdoor unit 30.

Outdoor unit 30 draws in environmental air through its sides as indicated by the arrows directed to the sides of the unit, forces the air through the outer unit coil using a fan, and expels the air. When operating as an air conditioner, the air is heated by the condenser coil within the outdoor unit and exits the top of the unit at a temperature higher than it entered the sides. Air is blown over indoor coil 32 and is then circulated through residence 24 by means of ductwork 20, as indicated by the arrows entering and exiting ductwork 20. The overall system operates to maintain a desired temperature as set by thermostat 22. When the temperature sensed inside the residence is higher than the set point on the thermostat (with the addition of a relatively small tolerance), the air conditioner will become operative to refrigerate additional air for circulation through the residence. When the temperature reaches the set point (with the removal of a relatively small tolerance), the unit can stop the refrigeration cycle temporarily.

When the unit in FIG. 1 operates as a heat pump, the roles of the coils are simply reversed. That is, the coil of outdoor unit 30 will serve as an evaporator to evaporate refrigerant and thereby cool air entering outdoor unit 30 as the air passes over the outdoor unit coil. Indoor coil 32 will receive a stream of air blown over it and will heat the air by condensing a refrigerant.

Figure 2:
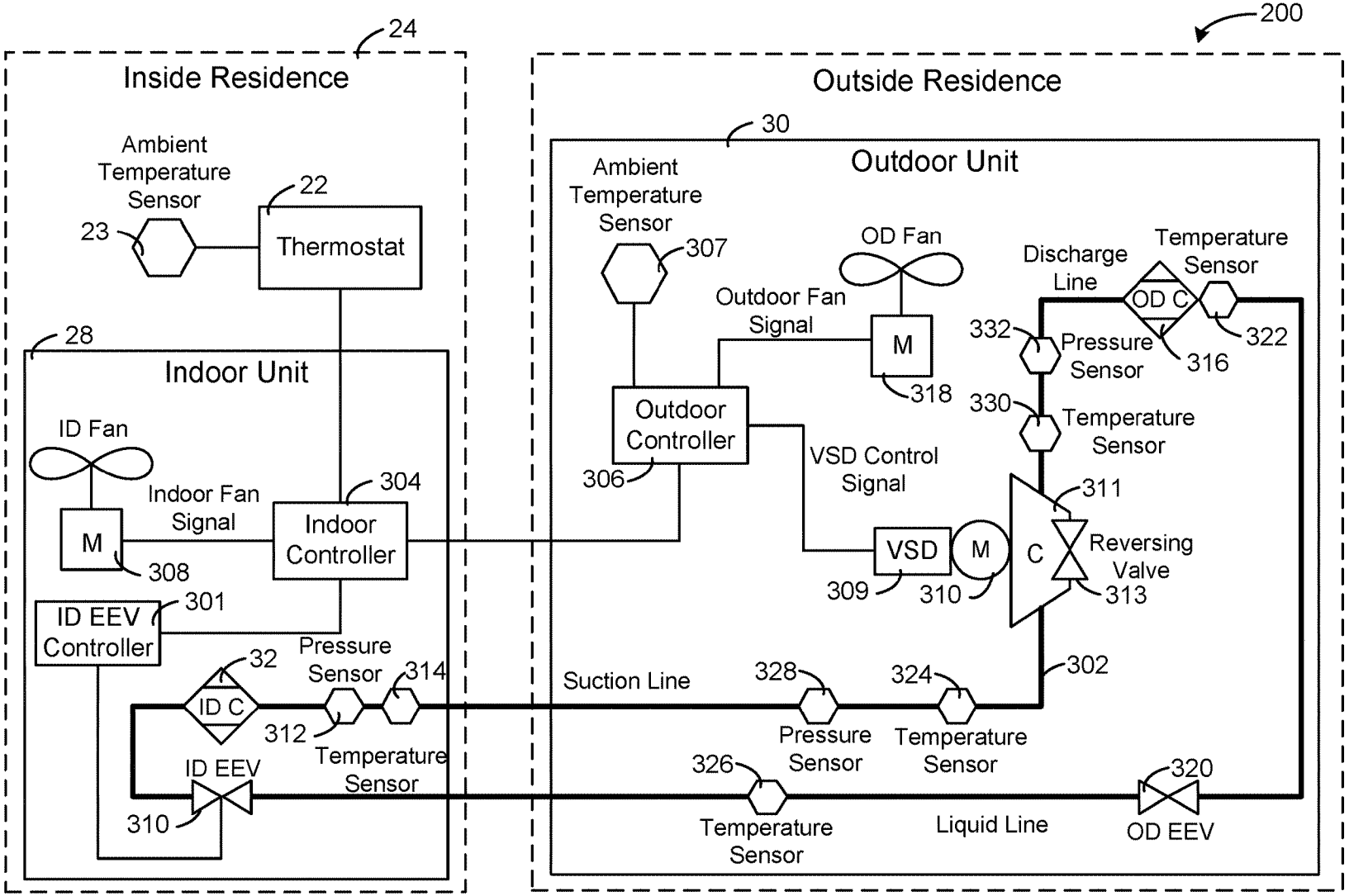
FIG. 2 is a schematic drawing of an indoor unit, an outdoor unit, an a refrigeration line of the heating and cooling system of FIG. 1, according to an exemplary embodiment.

In some embodiments, outdoor unit 30 can perform a defrost cycle. The defrost cycle may energize a reversing valve and cause an outdoor coil of outdoor unit 30 to be defrosted by running compressed refrigerant through the outdoor coil. In various embodiments, outdoor unit 30 initiates a defrost based on calibration data. This calibration data may indicate the proper time to initiate the defrost. Outdoor unit 30 can be configured to generate the calibration data. To generate the calibration data, outdoor unit 30 may first perform a sacrificial defrost. The sacrificial defrost may ensure that the outdoor coil is not frosted. After the sacrificial defrost is performed, the outdoor unit 30 can generate Referring now to FIG. 2, an HVAC system 200 is shown according to an exemplary embodiment. Various components of system 200 are located inside residence 24 while other components are located outside residence 24. Outdoor unit 30, as described with reference to FIG. 1-2, is shown to be located outside residence 24 while indoor unit 28 and thermostat 22, as described with reference to FIG. 1-2, are shown to be located inside residence 24.

Thermostat 22 can be configured to generate control signals for indoor unit 28 and/or outdoor unit 30. Thermostat 22 is shown to be connected to ambient temperature sensor 23 while outdoor controller 306 is shown to be connected to ambient temperature sensor 307. Ambient temperature sensor 23 and ambient temperature sensor 307 are any kind of temperature sensor (e.g., thermistor, thermocouple, etc.). Thermostat 22 may measure the temperature of residence 24 via ambient temperature sensor 23. Further, thermostat 22 can be configured to receive the temperature outside residence 24 via communication with outdoor controller 306. In various embodiments, thermostat 22 generates control signals for indoor unit 28 and outdoor unit 30 based on the indoor temperature (e.g., measured via ambient temperature sensor 23), the outdoor temperature (e.g., measured via ambient temperature sensor 307), and/or a temperature setpoint.

In various embodiments, thermostat 22 can cause indoor unit 28 and outdoor unit 30 to heat residence 24. In some embodiments, thermostat 22 can cause indoor unit 28 and outdoor unit 30 to cool residence 24. Further, thermostat 22 and/or outdoor controller 306 can be configured to initiate and perform a defrost cycle when system 200 is operating in a heating mode. When the outdoor temperature approaches freezing, moisture in the outside air that is directed over outdoor coil 316 may condense and freeze on the coil. Sensors may be included within outdoor unit 30 to measure the outside air temperature and the temperature of outdoor coil 316 (e.g., temperature sensor 322). These sensors may provide the temperature information to the outdoor controller 306 which can outdoor controller 306 can use to determine when to initiate a defrost cycle. A defrost cycle may be the same as a cooling cycle (e.g., same refrigerant flow and position of reversing valve 313), however, outdoor fan 318 may be deactivated during the defrost cycle. In various embodiments, a technician may be able to short out an input to outdoor controller 306 to immediately exit a defrost cycle. Further, during the defrost cycle, a suction pressure fault (e.g., a fault which is triggered based on the suction pressure measured by pressure sensor 328 going above a predefined amount) may be ignored. However, there may be an "absolute trip value" in place (e.g., 5 PSI) during the defrost cycle.

In some embodiments, thermostat 22 and/or outdoor controller 306 can determine an opportune time to enter a defrost cycle based on one or more sensing methods. The sensing methods may be sensing the refrigerant entering into all circuits (e.g., via temperature sensor 324, temperature sensor 322, temperature sensor 326, temperature sensor 314), suction pressure (e.g., via pressure sensor 328), determining if the temperature of air being blown over outdoor coil 316 and/or indoor coil 32 has been reduced, determining if the current draw of variable speed drive 309 and/or motor 310 has increased, etc. In various embodiments, thermostat 22 and/or outdoor controller 306 may utilize adapting levels to adjust triggering a defrost cycle based on suction pressure (e.g., via pressure sensor 328) and/or coil temperature (e.g., via temperature sensor 322).

In some instances, there is a pressure drop in conduits 302 when outdoor coil 316 begins to frost and/or the output of motor 310 begins to drop and the control process for motor 310 increases the output of motor 310 to maintain a desired speed (e.g., when motor 310 is an electrically commutated motor). In this regard, a limit or change limit for pressure and/or motor 310 output may be monitored at the start of a system cycle to determine when to enter a defrost cycle.

In some embodiments, outdoor unit 30 may have an outdoor coil with multiple circuits. The circuits may not frost at the same rate. In this regard, a single sensor may not accurately determine the time to enter a defrost cycle. For this reason, multiple sensors may need to be used to determine when to defrost the coil. Also, outdoor unit 30 may monitor and utilize operating conditions (e.g., stages) and speeds (e.g., speed of compressor 311) to determine when to enter into a defrost cycle.

Indoor unit 28 and outdoor unit 30 may be electrically connected as described with reference to FIG. 2. Further, indoor unit 28 and outdoor unit 30 may be coupled via conduits 302. Outdoor unit 30 can be configured to compress refrigerant inside conduits 302 to either heat or cool the building based on the operating mode of the indoor unit 28 and the outdoor unit 30 (e.g., heat pump operation or air conditioning operation). The refrigerant inside conduits 302 may be any fluid that absorbs and extracts heat. For example, the refrigerant may be hydro fluorocarbon (HFC) based R-410A, R-407C, and/or R-134a.

Outdoor unit 30 is shown to include outdoor controller 306, variable speed drive 309, motor 310 and compressor 311. Outdoor unit 30 can be configured to control compressor 311 and cause compressor 311 to compress the refrigerant inside conduits 302. In this regard, the compressor may be driven by variable speed drive 309 and motor 310. For example, outdoor controller 306 can generate control signals for variable speed drive 309. Variable speed drive 309 (e.g., an inverter, a variable frequency drive, etc.) may be an AC-AC inverter, a DC-AC inverter, and/or any other type of inverter. Variable speed drive 309 can be configured to vary the torque and/or speed of motor 310 which in turn drives the speed and/or torque of compressor 311. Compressor 311 may be any suitable compressor such as a screw compressor, a reciprocating compressor, a rotary compressor, a swing link compressor, a scroll compressor, or a turbine compressor, etc.

In some embodiments, outdoor controller 306 can control reversing valve 313 to operate system 200 as a heat pump or an air conditioner. For example, outdoor controller 306 may cause reversing valve 313 to direct compressed refrigerant to the indoor coil 32 while in heat pump mode and to the outdoor coil 316 while in air conditioner mode. In this regard, indoor coil 32 and outdoor coil 316 can both act as condensers and evaporators depending on the operating mode (i.e., heat pump or air conditioner) of system 200.

Further, in various embodiments, outdoor controller 306 can be configured to control and/or receive data from outdoor electronic expansion valve 320. Outdoor electronic expansion valve 320 may be an expansion valve controlled by a stepper motor. In this regard, outdoor controller 306 can be configured to generate a step signal (e.g., a PWM signal) for the outdoor electronic expansion valve 320. Based on the step signal, outdoor electronic expansion valve 320 can be held fully open, fully closed, partially open, etc. In various embodiments, the outdoor controller 306 can be configured to generate a step signal for the outdoor electronic expansion valve 320 based on a subcool and/or superheat value calculated from various temperatures and pressures measured in system 200.

Outdoor controller 318 can be configured to control and/or power outdoor fan 318. Outdoor fan 318 can be configured to blow air over outdoor coil 316. In this regard, outdoor controller 306 can control the amount of air blowing over the outdoor coil 316 by generating control signals to control the speed and/or torque of outdoor fan 318. In some embodiments, the control signals are pulse wave modulated signals (PWM), analog voltage signals (i.e., varying the amplitude of a DC or AC signal), and/or any other type of signal.

Outdoor unit 30 may include one or more temperature sensors and one or more pressure sensors. The temperature sensors and pressure sensors may be electrical connected (i.e., via wires, via wireless communication, etc.) to outdoor controller 306. In this regard, outdoor controller 306 can be configured to measure and store the temperatures and pressures of the refrigerant at various locations of conduits 302. The pressure sensors may be any kind of transducer that can be configured to sense the pressure of the refrigerant in conduits 302. Outdoor unit 30 is shown to include pressure sensor 328. Pressure sensor 328 may measure the pressure of the refrigerant in conduit 302 in the suction line (i.e., a predefined distance from the inlet of compressor 311. Further, outdoor unit 30 is shown to include pressure sensor 332. Pressure sensor 332 may be configured to measure the pressure of the refrigerant in conduits 302 on the discharge line (e.g., a predefined distance from the outlet of compressor 311).

The temperature sensors of outdoor unit 30 may include thermistors, thermocouples, and/or any other temperature sensing device. Outdoor unit 30 is shown to include temperature sensor 322, temperature sensor 324, temperature sensor 326, and temperature sensor 330. The temperature sensors (i.e., temperature sensor 322, temperature sensor 324, temperature sensor 326, and/or temperature sensor 330) can be configured to measure the temperature of the refrigerant at various locations inside conduits 302. Temperature sensor 322 can be configured to measure the temperature of the refrigerant inside, at the inlet to, and/or at the outlet of outdoor coil 316. Temperature sensor 324 can be configured to measure the temperature of the refrigerant inside the suction line (i.e., a predefined distance from the inlet of compressor 311. Temperature sensor 326 can be configured to measure the temperature of the liquid line (i.e., a predefined distance from the outlet of the outdoor coil 316). Further, temperature sensor 330 can be configured to measure the temperature of the discharge line (i.e., a predefined distance from the outlet of the compressor and/or a predefined distance from the inlet of the outdoor coil 316).

Referring now to indoor unit 28, indoor unit 28 is shown to include indoor controller 304, indoor electronic expansion valve controller 301, indoor fan 308, indoor coil 32, indoor electronic expansion valve 310, pressure sensor 312, and temperature sensor 314. Indoor controller 304 can be configured to generate control signals for indoor electronic expansion valve controller 301. The signals may be setpoints (e.g., temperature setpoint, pressure setpoint, superheat setpoint, subcool setpoint, step value setpoint, etc.). In this regard, indoor electronic expansion valve controller 301 can be configured to generate control signals for indoor electronic expansion valve 310. In various embodiments, indoor electronic expansion valve 310 may be the same type of valve as outdoor electronic expansion valve 320. In this regard, indoor electronic expansion valve controller 301 can be configured to generate a step control signal (e.g., a PWM wave) for controlling the stepper motor of electronic expansion valve 310. In this regard, indoor electronic expansion valve controller 301 can be configured to fully open, fully close, or partially close electronic expansion valve based on the step signal.

Indoor controller 304 can be configured to control indoor fan 308. Indoor fan 308 can be configured to blow air over indoor coil 32. In this regard, indoor controller 304 can control the amount of air blowing over the indoor coil 308 by generating control signals to control the speed and/or torque of indoor fan 308. In some embodiments, the control signals are pulse wave modulated signals (PWM), analog voltage signals (i.e., varying the amplitude of a DC or AC signal), and/or any other type of signal.

Indoor controller 304 may be electrically connected (e.g., wired connection, wireless connection, etc.) to pressure sensor 312 and/or temperature sensor 314. In this regard, indoor controller 304 can take pressure and/or temperature sensing measurements via pressure sensor 312 and/or temperature sensor 314. Pressure sensor 312 may be located on the suction line (i.e., a predefined distance from indoor coil 32) while temperature sensor 314 may be located a predefined distance from the outlet of indoor coil 32 and/or next to pressure sensor 312 (e.g., on the vapor line).

Figure 3:
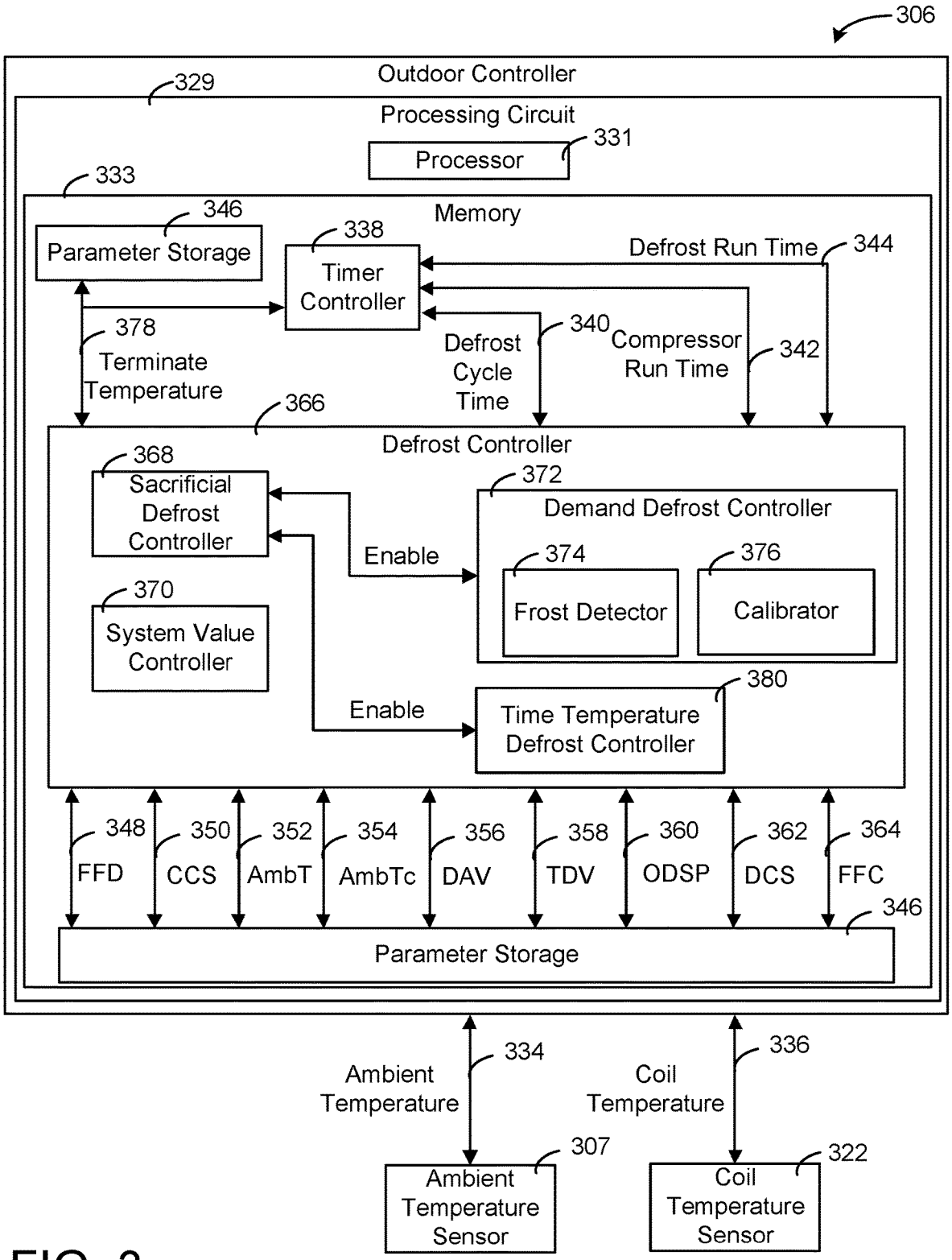
FIG. 3 is a block diagram of the outdoor controller of the outdoor unit of FIG. 2, according to an exemplary embodiment.

Referring now to FIG. 3, a block diagram of outdoor controller 306 is shown in greater detail, according to an exemplary embodiment. Outdoor controller 306 is configured to operate outdoor unit 30 to heat and/or cool residence 24. In addition to heating and cooling residence 24, outdoor controller 306 may be configured to perform a defrost cycle. In various embodiments, outdoor controller 306 uses calibration data to determine the opportune times to perform the defrost cycle. Further, outdoor controller 306 may be configured to generate the calibration data. Outdoor controller 306 is shown to include processing circuit 329. Processing circuit 329 can be configured to perform all of the control features of outdoor controller 306 (e.g., operating in a heating mode, operating in a cooling mode, performing a defrost cycle, generating calibration data, etc.). Processing circuit 329 is shown to include processor 331 and memory 333.

In addition to containing all the instructions to operate outdoor controller 306, memory 333 may include the instructions to defrost outdoor coil 316. These instructions may cause reversing valve 313 to be energized or de-energized. In some embodiments, processor 331 executes the defrost instructions stored in memory 333. Processor 331 can be a general purpose or specific purpose processor, an application specific integrated circuit (ASIC), one or more field programmable gate arrays (FPGAs), a group of processing components, or other suitable processing components. Processor 331 may be configured to execute computer code and/or instructions stored in memory 333 or received from other computer readable media (e.g., CDROM, network storage, a remote server, etc.).

Memory 333 can include one or more devices (e.g., memory units, memory devices, storage devices, etc.) for storing data and/or computer code for completing and/or facilitating the various processes described in the present disclosure. Memory 333 can include random access memory (RAM), read-only memory (ROM), hard drive storage, temporary storage, non-volatile memory, flash memory, optical memory, or any other suitable memory for storing software objects and/or computer instructions. Memory 333 can include database components, object code components, script components, or any other type of information structure for supporting the various activities and information structures described in the present disclosure. Memory 333 can be communicably connected to processor 331 via processing circuit 329 and can include computer code for executing (e.g., by processor 331) one or more processes described herein. Memory 333 is shown to include parameter storage 346, timer controller 338, defrost controller 366, sacrificial defrost controller 368, system value controller 370, demand defrost controller 372, frost detector 374, calibrator 376, and time temperature defrost controller 380. The functions of these elements may be combined into a single element, multiple elements, and can be performed by outdoor controller 306 and/or processing circuit 329.

Outdoor controller 306 and/or processing circuit 329 are shown to be in communication with ambient temperature sensor 307 and coil temperature sensor 322. In this regard, outdoor controller 306 is configured to receive ambient temperature 334 from ambient temperature sensor 307 and coil temperature 336 from coil temperature sensor 322. Ambient temperature 334 may be the outdoor temperature measured a predefined distance from outdoor coil 316, outdoor controller 306, and/or outdoor unit 30. Coil temperature 336 may be the coil temperature of outdoor coil 316. The various components of processing circuit 329 (e.g., processor 331 and memory 333) may receive and utilize ambient temperature 334 and coil temperature 336 to initiate a calibration cycle in addition to determining calibration data.

Memory 333 is shown to include timer controller 338. Timer controller 338 may be any software or hardware module that includes one or more hardware timers (e.g., timer counters, real-time clocks, etc.), software times (e.g., timers emulated from another timer counter, a time stamping mechanism, etc.) and/or any kind of time keeping logic. Timer controller 338 may record time (e.g., defrost cycle time 340, compressor run time 342, and defrost run time 344) via one or more timers and communicate the recorded time to defrost controller 366. Timer controller 338 may include one or more separate timers which count defrost cycle time 340, compressor run time 342, and defrost run time 344.

Timer controller 338 may accumulate compressor run time 342 when outdoor unit 30 operates in a heating mode based on a heating call received from thermostat 22. Timer controller 338 can be configured to clear compressor run time 342 after a defrost cycle has been performed. In some embodiments, compressor run time 342 is cleared after demand defrost controller 372 and/or time temperature defrost controller 380 perform a defrost cycle and/or after sacrificial defrost controller 368 performs a defrost.

Defrost run time 344 may be the amount of time timer controller 338 counts when coil temperature 336 is below a predefined temperature (e.g., 35 degrees Fahrenheit). If coil temperature 336 is above terminate temperature 378 timer controller 338 can be configured to reset defrost run time 344 (e.g., set to zero). Further, when outdoor controller 306 is performing a defrost cycle, timer controller 338 may record the amount of time which the outdoor controller 306 is in the defrost cycle (i.e., defrost cycle time 340).

Parameter storage 346 may be a module of memory 333 configured to store, retrieve, overwrite, and/or update various system parameters. Parameter storage 346 may communicate stored values to defrost controller 366 in addition to saving, overriding, and/or updating a parameter in parameter storage 346 based on values received from defrost controller 366. Parameter storage 346 may store FFD 348 (Frost Free DeltaT), a value determined by calibrator 376. Further, parameter storage 346 may store CCS 350 (Calibrated Compressor Speed). This value may be the compressor speed which is stored by system value controller 370 and/or calibrator 376 before entering a sacrificial defrost and outdoor controller 306 may operate at during a calibration cycle.

Parameter storage 346 is shown to store AmbT 352 (Current Ambient Temperature). AmbT 352 may be the ambient temperature 334 measured by ambient temperature sensor 307 which is used by frost detector 374 to determine when to perform a defrost and/or calibrator 376 to generate calibration data. AmbTc (Calibrated Ambient Temperature) 354 stored by parameter storage 346 may be the ambient temperature 334 measured by calibrator 376 during a calibration cycle. DAV 356 (Defrost Active Variable) may be a variable used to initiate a defrost cycle and is stored by parameter storage 346. In various embodiments, DAV 356 may be generated by frost detector 374 and/or calibrator 376. TDV 358 (Temperature Dependent Variable) may be a value calculated by defrost controller 366 based on ambient temperature 334 and is shown to be stored by parameter storage 346.

ODSP 360 (Calibrated OD EEV Setpoint) may be the setpoint value of outdoor EEV 320 that is stored before a sacrificial defrost by system value controller 370. DCS 362 (Defrost Compressor Speed) may be a compressor speed which outdoor controller 306 will operate at during a defrost cycle and/or a sacrificial defrost cycle. DCS 362 may be dependent on unit tonnage. In various embodiments, system value controller 370 retrieves DCS 362 based on unit tonnage of outdoor unit 30 and causes variable speed drive 309, motor 310, and/or compressor 311 to operate at DCS 362 when outdoor controller 306 is performing a defrost cycle and/or sacrificial defrost cycle. FFC (Frost Free Curve) 364 may be a value determined by frost detector 374 and/or calibrator 376 based on calibration data and can be used to determine a time at which to enter a defrost cycle.

Terminate temperature 378 is shown to be stored by parameter storage 346. Terminate temperature 378 may be a temperature set by a user or technician via a jumper, a user interface, a remote connection, etc. In some embodiments, terminate temperature 378 may be 50 degrees Fahrenheit, 60 degrees Fahrenheit, 70 degrees Fahrenheit, 80 degrees Fahrenheit and/or any other temperature. In some embodiments, timer controller 338 can be configured to reset defrost run time 344 if coil temperature 336 meets and/or exceeds terminate temperature 378. Further, a defrost cycle operated by either demand defrost controller 372 and/or sacrificial defrost controller 368 may be terminated by sacrificial defrost controller 368 and/or demand defrost controller 372 in response to demand defrost controller 372 and/or sacrificial defrost controller 368 determining that coil temperature sensor 322 exceeds and/or equals terminate temperature 378.

Defrost controller 366 can be configured to cause system 200, as described with further reference to FIG. 2, to perform a defrost cycle. In this regard, defrost controller 366 can be configured to send signals to various components (e.g., variable speed drive 309, outdoor fan 318, indoor fan 308, reversing valve 313, outdoor EEV 320, indoor EEV 310, etc.) causing those components to perform a defrost cycle. Further, defrost controller 366 can be configured to communicate with timer controller 338 to determine compressor run time 342, defrost run time 344, and defrost cycle time 340. Further, defrost controller 366 can be configured to communicate with parameter storage 346 to retrieve and/or store various system values (e.g., terminate temperature 378, DAV 356, etc.) In some embodiments, defrost controller 366 can be configured to enter a defrost cycle if timer controller 338 indicates that compressor run time 342 equals a predefined amount (e.g., 6 hours) during a heating call without a defrost cycle occurring and ambient temperature 334 is under a predefined temperature (e.g., 50 degrees Fahrenheit). In some embodiments, this defrost may be a short defrost (e.g., a six minute defrost). This may be a "catch all" defrost which is a periodic defrost.

Defrost controller 366 is shown to include sacrificial defrost controller 368. Sacrificial defrost controller 368 can be configured to enter a sacrificial defrost cycle (e.g., a defrost cycle) after the outdoor controller 306 is turned on (e.g., receives a heating call, is power cycled, etc.) and/or is in an uncalibrated state (e.g., has just received a heating call, has been power cycled, etc.). In some embodiments, sacrificial defrost controller 368 enters the sacrificial defrost cycle when defrost run time 344 is equal to a predefined amount (e.g., 31 minutes) and outdoor controller 306 is in an uncalibrated state (e.g., has just received a heating call, has been power cycled, etc.). Sacrificial defrost controller 368 can be configured to exit the sacrificial defrost if one or more conditions are met. In some embodiments, sacrificial defrost controller 368 can be configured to exit the sacrificial defrost cycle based on defrost cycle time 340 equaling a predefined amount (e.g., 10-20 minutes). In some embodiments, sacrificial defrost controller 368 can be configured to exit the sacrificial defrost if a termination temperature is met (e.g., terminate temperature 378).

Based on the method for exiting the sacrificial defrost, sacrificial defrost controller 368 can enable demand defrost controller 372 and/or time temperature defrost controller 380. If sacrificial defrost controller 368 exits the sacrificial defrost based on determining that the coil temperature 336 has reached terminate temperature 378 (Equation A) or if during the temperature of outdoor coil 316 has been above a predefined temperature (e.g., 35 degrees Fahrenheit) for a predefined amount of time (e.g., 4 minutes) (Equation B) sacrificial defrost controller 368 enables demand defrost controller 372. If neither of these conditions are met (Equation C), and sacrificial defrost controller 368 exits the sacrificial defrost based on defrost cycle time 340 equaling a predefined amount, sacrificial defrost controller 368 can be configured to attempt another sacrificial defrost in response to defrost run time 344 being equal to a predefined amount (e.g., 31 minutes) and/or may enable time temperature defrost controller 380. If time temperature defrost controller 380 is enabled and time temperature defrost controller 380 performs a defrost, sacrificial defrost controller 368 may be configured to perform another sacrificial defrost after a predefined amount of time (e.g., when defrost run time 344 is equal to a predefined amount). The following relationships exemplify relationships that sacrificial defrost controller 368 may utilize to exit a sacrificial defrost and/or enable demand defrost controller 372 and/or time temperature defrost controller 380:

Coil Temperature=Terminate Temperature — Equation A

Coil Temperature>Predefined Temperature for Time B — Equation B

Defrost Cycle Time=Time C and Equations A and B are false — Equation C

Demand defrost controller 372 is shown to include frost detector 374 and calibrator 376. In response to sacrificial defrost controller 368 enabling demand defrost controller 372, demand defrost controller 372 may cause calibrator 376 to perform a calibration. Further, demand defrost controller 372 can be configured to cause frost detector 374 to detect frost accumulation and initiate a defrost cycle after calibrator 376 has performed the calibration and frost is detected.

Calibrator 376 can be configured generate and/or record calibration data (e.g., FFD 348, FFC 364, CCS 350, ODSP 360, and/or AmbTc 354). The calibration data may be stored in parameter storage 346. Calibrator 376 can be configured to clear (e.g., erase, overwrite, etc.) calibration data if outdoor unit 30 receives a call for heating, unit 30 and/or outdoor controller 306 is power cycled, etc. Calibrator 376 may cause outdoor unit 30 to operate at CCS 350 and/or ODSP 360 while determining the calibration data. Calibrator 376 can be configured to wait a predefined amount of time (e.g., a 5 minute stabilizing period) before determining the calibration data.

Calibrator 376 can be configured to record ambient temperature 334 and/or coil temperature 336. Based on the recorded values, calibrator 376 can generate calibration data. In some embodiments, calibrator 376 measures the values once every time period (e.g., every minute, every thirty seconds, etc.) for a predefined amount of time (e.g., 3 minutes, 4 minutes, 5 minutes, etc.). Calibrator 376 can be configured to average the readings after the predefined amount of time has expired. In this regard, calibrator 376 may include any time keeping device (e.g., timer controller 338) that can be used to measure time. Calibrator 376 may not overwrite any calibration data (e.g., AmbTc 354 and/or FFD 348) until the average values for ambient temperature 334 and coil temperature 336 are determined. In this regard, any interruption to the calibration cycle (e.g., a heating call ending) will not cause calibration data to be lost. In some embodiments, if a heating call is met during the calibration, outdoor controller 306 may return to an uncalibrated state and wait for another heating call.

Calibrator 376 can be configured to generate and store calibration data. The calibration data generated by calibrator 376 may be AmbTc 354 and FFD 348. AmbTc 354 may be the averaged ambient temperature 334. FFD 348 may be calculated from the AmbTc 354 and the averaged coil temperature 336. The following equation represents the computation for FFD 348:

$$FFD=(AmbTc-coilT) \qquad \text{Equation 1}$$

Calibrator 376 can be configured to pause for a predefined amount of time after a calibration has been performed (e.g., 31 minutes). This may prevent any unnecessary defrost for occurring quickly after the sacrificial defrost cycle and the calibration data generation. Further, calibrator 376 can be configured to pause a predefined amount of time (e.g., a settling time) before generating the calibration data, this may allow system 200 (e.g., ambient temperature 334, coil temperature 336) to reach a steady state. In some embodiments, this settling time may be performed while system value controller 370 operates system 200 at CCS 350 and ODSP 360.

Frost detector 374 can be configured to initiate a defrost cycle based on coil temperature 336, ambient temperature 334, and the calibration data (e.g., FFD 348 and/or AmbTc 354). Frost detector 374 can be configured to initiate the defrost cycle if the difference between ambient temperature 334 and coil temperature 336 is greater than or equal to DAV 356. The equation for initiating the defrost cycle can be represented as:

$$(AmbT-coiln \geq DAV \text{ if true, initiate defrost} \qquad \text{Equation 2}$$

Frost detector 374 can determine AmbT 352 by measuring ambient temperature sensor 307, determine coilT by measuring coil temperature sensor 322, and can calculate DAV 356. Frost detector 374 can be configured to determine DAV 356 by determining FFC 364 from the calibration data (e.g., FFD 348 and/or AmbTc 354) (Equation 3), determining TDV 358 (Equations 4-7), and adding FFC 364 with TDV 358 (Equation 8). Frost detector 374 can determine FFC 364 with the following relationship, wherein AmbT 352 is the ambient temperature measured by ambient temperature sensor 307, AmbTc 354 is the ambient temperature determined by calibrator 376, FDD 348 determined by calibrator 376, and Defrost DeltaT Change is a predefined value (e.g., 8):

$$FFC = FFD + \frac{AmbT - AmbTc}{\text{Defrost } DeltaT \text{ Change}} \qquad \text{Equation 3}$$

The frost detector 374 can be configured to determine TDV 358 based on a current coil temperature measured by coil temperature sensor 322. Frost detector 374 can be configured to select a TDV value based on the following relationships, wherein coilT is coil temperature 336 measured by coil temperature sensor 322 and A, B, C, D, E, F, a, b, c, d, e, and f are predefined constants:

$$TDV=A \text{ when } coilT \geq a^\circ \text{ F.} \qquad \text{Equation 4}$$

$$TDV=B*coilT+C \text{ when } coilT=b^\circ \text{ F.}-c^\circ \text{ F.} \qquad \text{Equation 5}$$

$$TDV=D*coilT+E \text{ when } coilT=d^\circ \text{ F.}--e^\circ \text{ F.} \qquad \text{Equation 6}$$

$$TDV=F \text{ when } coilT \leq -f^\circ \text{ F.} \qquad \text{Equation 7}$$

$$DAV=TDV+FFC \qquad \text{Equation 8}$$

Frost detector 374 can be configured to initiate a defrost cycle in response to determining that Equation 2 is true and/or has been true for a predefined amount of time (e.g. 5 minutes). In some embodiments, frost detector 374 initiates a defrost cycle in response to determining that Equation 2 is true and/or in response to determining that defrost run time 344 is equal to a predefined amount of time (e.g., 31 minutes).

System value controller 370 can be configured to save a control location (e.g., control step) of a control process prior to entering a defrost cycle, a sacrificial defrost cycle, and/or a calibration, and resume operation of outdoor controller 306 at the saved control location after the defrost cycle, the sacrificial defrost cycle, and/or the calibration. In this regard, system value controller 370 can record various system parameters (e.g., EEV setpoint value (e.g., ODSP 360), superheat setpoint, compressor speed, fan speed, etc.) of various components of system 200 as described with reference to FIG. 2. In response to a defrost cycle ending, a sacrificial defrost cycle ending, and/or a calibration ending, system value controller 370 can be configured to resume at the saved parameters. In various embodiments, system value controller 370 records a control step location of a control process prior to the sacrificial defrost and resume at the saved control step after the sacrificial defrost has completed (e.g., exited). In some embodiments, the control process may be the process which causes system 200, as described with reference to FIG. 2, to heat residence 24, as described with reference to FIGS. 1-2. In this regard, recording the step of the heating process may allow outdoor controller 306 to resume operating heating residence 24 at the step recorded before operating the sacrificial defrost, defrost, and/or calibration.

System value controller 370 can be configured to operate various system components at various values before, during, and/or after a defrost cycle (e.g., a defrost commanded by sacrificial defrost controller 368, demand defrost controller 372, and/or time temperature defrost controller 380) and/or a calibration cycle. In various embodiments, when sacrificial defrost controller 368 and/or demand defrost controller 372 initiate a defrost cycle, system value controller 370 may record one or more current operating parameters of the system (e.g., ODSP 360, CCS 350, etc.). During the defrost cycle, system value controller 370 can select various operating values for various components of system 200 as described with reference to FIG. 2. In some embodiments, the values are selected based on unit size (e.g., tonnage). The values may be selected for compressor speed (e.g., DCS 362), a setpoint for indoor EEV 310, an airflow value for indoor fan 308, etc. Further, system value controller 370 may cause reversing valve 313 to become energized while operating outdoor EEV 320 in a fully open position.

In response to the defrost cycle commanded by sacrificial defrost controller 368, time temperature defrost controller 380, and/or demand defrost controller 372 ending a defrost cycle, system value controller 370 may select system values of various components of system 200. In some embodiments, the system values may be selected based on the recorded values (e.g., recorded EEV setpoint value (e.g., ODSP 360), recorded compressor speed (e.g., CCS 350), etc.). Some system values may be predefined after exiting a defrost cycle. In some embodiments, indoor EEV 310 is fully open, outdoor fan 318 is commanded to a speed based on the recorded compressor speed (e.g., CCS 350), indoor fan 308 is changed to a proper fan speed, etc.

Time temperature defrost controller 380 can be configured to perform a defrost cycle. Time temperature defrost controller 380 may be configured to perform a defrost cycle a predefined amount of time after sacrificial defrost controller 368 performs a sacrificial defrost. In this regard, time temperature defrost controller 380 may receive an enable signal from sacrificial defrost controller 368. In response to receiving an enable signal from sacrificial defrost controller 368, time temperature defrost controller 380 can be configured to determine if coil temperature 336 has been under a predefined amount (e.g., 35 degrees Fahrenheit) for a predefined amount of time (e.g., 31 minutes). If time temperature defrost controller 380 determines that coil temperature 336 has been under the predefined amount for the predefined amount of time, time temperature defrost controller 380 may initiate a defrost. After the defrost is concluded, time temperature defrost controller 380 can cause sacrificial defrost controller 368 to be enabled, that is, wait a predefined amount of time before performing another sacrificial defrost cycle.

Figure 4:
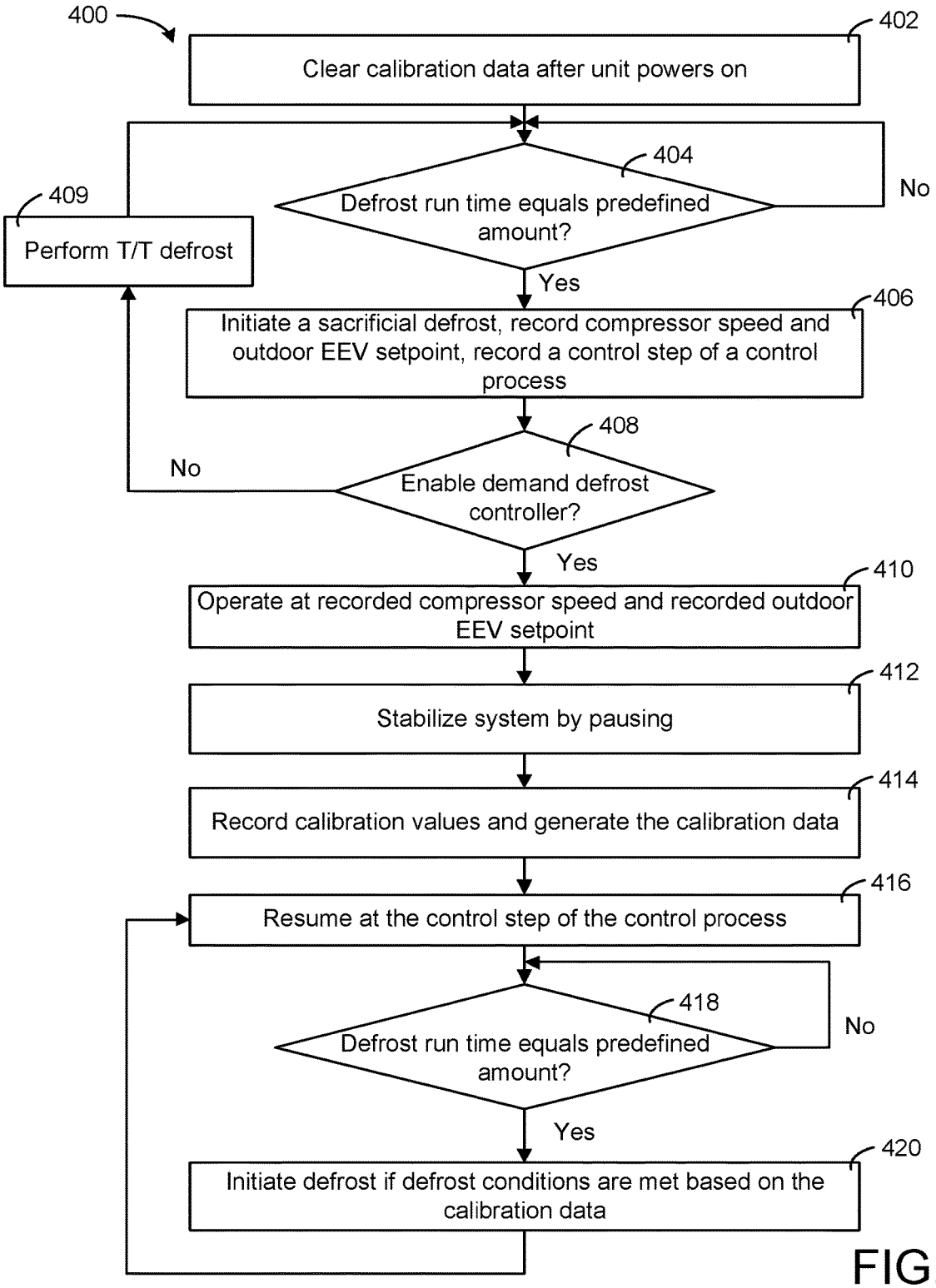
FIG. 4 is a flowchart of operations for performing a defrost with the controller of FIGS. 2-3.

Referring now to FIG. 4, a process 400 is shown for operating a defrost cycle of outdoor unit 30 with outdoor controller 306, according to an exemplary embodiment. In step 402, calibrator 376 can be configured to clear various system values in response to a power cycle, a unit being commanded into a heating cycle from standby, etc. In some embodiments, the values cleared may be FFD 348, FFC 364, CCS 350, ODSP 360, AmbTc 354, etc. In step 404, sacrificial defrost controller 368 waits until defrost run time 344 equals a predefined amount (e.g., 31 minutes). If defrost run time 344 equals the predefined amount, sacrificial defrost controller 368 and/or system value controller 370 can record CCS 350, ODSP 360, and a control step of a control process prior to a sacrificial defrost and initiate the sacrificial defrost for a predefined amount of time (e.g., 12 minutes) (step 406).

In step 408, sacrificial defrost controller 368 determines if demand defrost controller 372 should be enabled (proceed to step 410). Sacrificial defrost controller 368 may determine if demand defrost controller 372 should be enabled based on coil temperature 336. In response to determining that coil temperature 336 has been above a predefined amount (e.g., 31 degrees Fahrenheit) for a predefined amount of time (e.g., four minutes) (i.e., Equation B is true) during the sacrificial defrost, sacrificial defrost controller 368 may enabled defrost controller 372 (proceed to step 410). Also, if sacrificial defrost controller 368 determines that a predefined coil temperature has been reached (i.e., Equation A is true), sacrificial defrost controller 368 may enable demand defrost controller 372 (i.e., proceed to step 410). If sacrificial defrost controller 368 does not enable demand defrost controller 372 (i.e., Equation C is true), sacrificial defrost controller 368 can enable time temperature defrost controller 380 and process 400 proceeds to step 409. In step 409, time temperature defrost controller 380 may perform a defrost cycle if coil temperature 336 is less than a predefined amount for a predefined amount of time. In response to coil temperature 336 being less than the predefined amount for the predefined amount of time, time temperature defrost controller 380 may perform a defrost cycle. Once the defrost cycle concludes, process 400 may proceed to step 404.

In step 410, system value controller 370 and/or calibrator 376 may cause outdoor unit 30 to operate at the values recorded in step 406 (e.g., ODSP 360, CCS 350, etc.). In step 412, calibrator 376 may wait a predefined amount of time. This may allow ambient temperature 334 and/or coil temperature 336 to stabilize. In step 414, calibrator 376 can be configured to record ambient temperature 334 and/or coil temperature 336. Calibrator 376 can generate the calibration data based on ambient temperature 334 and coil temperature 336. In some embodiments, the calibration data generated by calibrator 376 is FFD 348 and/or AmbTc 354. Calibrator 376 may generate FFD 348 according to Equation 1. In step 416, system value controller 370 can return to the recorded control step of the control process recorded in step 406.

In step 418, if defrost run time 344 is equal to a predefined amount of time, step 420 may be performed, otherwise, step 418 may be looped. In step 420, frost detector 374 determines if a defrost cycle should be initiated based on coil temperature 336, ambient temperature 334, and/or the calibration data (e.g., FFD 348, AmbTc 354, etc.). In some embodiments, frost detector 374 initiates a defrost cycle in response to determining that Equation 2 is true. In some embodiments, frost detector 374 may evaluate Equation 2 based on the calibration data (e.g., FFD 348, AmbTc 354), ambient temperature 334, coil temperature 336, and Equations 3-8.

Configuration of Exemplary Embodiments

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A system for heating a building via refrigerant, the system comprising:

a coil temperature sensor configured to measure a coil temperature of an outdoor coil and an ambient temperature sensor configured to measure an outdoor ambient temperature;

a controller comprising a processing circuit, the processing circuit configured to:

execute a control algorithm to operate the system to heat the building;

record a system operating parameter indicating a current operating status of the system and an execution location obtains from the control algorithm before performing a sacrificial defrost cycle, wherein the recorded system operating parameter comprises a speed of a compressor;

cause the system to perform the sacrificial defrost cycle and operate the system at predefined system operating parameters other than the recorded system operating parameter;

cause the system to operate at the recorded system operating parameter and generate calibration data in response to an ending of the sacrificial defrost cycle by recording the measured coil temperature measured by the coil temperature sensor and the measured outdoor ambient temperature measured by the ambient temperature sensor;

cause the control algorithm to operate at the recorded execution location obtains from the control algorithm; and cause the system to perform a defrost cycle based on the generated calibration data, the measured coil temperature measured by the coil temperature sensor, and the measured outdoor ambient temperature measured by the ambient temperature sensor.

2. The system of claim 1, wherein the processing circuit is configured to perform another sacrificial defrost cycle in response to determining that the measured coil temperature measured by the coil temperature sensor is below a predefined coil temperature during the sacrificial defrost cycle.

3. The system of claim 1, wherein the processing circuit is configured to cause the system to perform the defrost cycle based on the generated calibration data, the measured coil temperature measured by the coil temperature sensor, and the measured outdoor ambient temperature measured by the ambient temperature sensor in response to a predefined amount of time after the sacrificial defrost cycle in which the measured coil temperature measured by the coil temperature sensor is above a predefined coil temperature during the sacrificial defrost cycle.

4. The system of claim 1, wherein the processing circuit is configured to cause the system to perform the defrost cycle based on the generated calibration data, the measured coil temperature measured by the coil temperature sensor, and the measured outdoor ambient temperature measured by the ambient temperature sensor in response to a predefined amount of time elapsing after the sacrificial defrost cycle in which the measured coil temperature measured by the coil temperature sensor is below a predefined coil temperature.

5. The system of claim 1, wherein the generated calibration data comprises the recorded outdoor ambient temperature and a difference between the recorded outdoor ambient temperature and the recorded coil temperature.

6. The system of claim 5, wherein the processing circuit is configured to determine a frost free curve (FFC) based on the recorded outdoor ambient temperature, the difference between the recorded outdoor ambient temperature and the recorded coil temperature, and a current outdoor ambient temperature measured by the ambient temperature sensor.

7. The system of claim 6, wherein the processing circuit is configured to:

determine a defrost active variable (DAV) based on a temperature dependent variable (TDV) and the FFC, wherein the TDV is dependent on a current coil temperature; and perform the defrost cycle in response to determining that a second difference between the current outdoor ambient temperature and the current coil temperature is greater than the DAV, wherein the current outdoor ambient temperature is measured by the ambient temperature sensor and the current coil temperature is measured by the coil temperature sensor.

8. The system of claim 7, wherein the processing circuit is configured to determine the TDV based on the current coil temperature and one or more relationships, wherein each of the one or more relationships relates to a predefined range of coil temperature values.

9. The system of claim 1, wherein the processing circuit causes the system to perform the sacrificial defrost cycle in response to a predefined amount of time elapsing while the measured coil temperature measured by the coil temperature sensor is below a predefined coil temperature.

10. The system of claim 1, wherein the processing circuit is configured to cause the system to perform the defrost cycle after a predefined amount of time in which no defrost cycle is performed.

11. A method for defrosting an outdoor coil of a heating system, the method comprising:

measuring a coil temperature via a coil temperature sensor and measuring an ambient temperature via an ambient temperature sensor;

executing a control algorithm for defrosting the outdoor coil of the heating system;

recording a speed of a compressor, an opening setpoint of an electronic expansion valve, and an execution location obtains from the control algorithm before performing a sacrificial defrost cycle;

performing the sacrificial defrost cycle and operating the heating system at a predefined electronic expansion valve opening setpoint and a predefined compressor speed other than the recorded speed of the compressor and the recorded electronic expansion valve opening setpoint;

causing the heating system to operate at the recorded speed of the compressor and the recorded electronic expansion valve opening setpoint in response to an ending of the sacrificial defrost cycle;

generating calibration data based on the measured coil temperature measured by the coil temperature sensor and the measured ambient temperature measured by the ambient temperature sensor by recording the measured coil temperature measured by the coil temperature sensor and recording the measured ambient temperature measured by the ambient temperature sensor;

causing the control algorithm to operate at the recorded execution location obtains from the control algorithm in response to the ending of the sacrificial defrost cycle; and causing the heating system to perform a defrost cycle based on the generated calibration data, the measured coil temperature measured by the coil temperature sensor, and the measured ambient temperature measured by the ambient temperature sensor.

12. The method of claim 11, further comprising performing another sacrificial defrost cycle in response to determining that the measured coil temperature measured by the coil temperature sensor is below a predefined coil temperature during the sacrificial defrost cycle.

13. The method of claim 11, further comprising causing the heating system to perform the defrost cycle based on the generated calibration data, the measured coil temperature measured by the coil temperature sensor, and the measured ambient temperature measured by the ambient temperature sensor in response to a predefined amount of time after the sacrificial defrost cycle in which the measured coil temperature measured by the coil temperature sensor is above a predefined coil temperature during the sacrificial defrost cycle.

14. The method of claim 11, further comprising causing the heating system to perform the defrost cycle based on the generated calibration data, the measured coil temperature measured by the coil temperature sensor, and the measured ambient temperature measured by the ambient temperature sensor in response to a predefined amount of time elapsing in which the measured coil temperature measured by the coil temperature sensor is below a predefined coil temperature.

15. The method of claim 11, wherein the generated calibration data comprises a difference between the recorded ambient temperature and the recorded coil temperature.

16. The method of claim 15, further comprising:

determining a defrost active variable (DAV) based on a temperature dependent variable (TDV) and a frost free curve (FFC); and causing the heating system to perform the defrost cycle in response to determining that a second difference between a current ambient temperature measured by the ambient temperature sensor and a current coil temperature measured by the coil temperature sensor is greater than the DAV.

17. The method of claim 16, further comprising determining the FFC based on the recorded ambient temperature, the difference between the recorded ambient temperature and the recorded coil temperature, and the current ambient temperature measured by the ambient temperature sensor.

18. The method of claim 16, further comprising determining the TDV based on the current coil temperature measured by the coil temperature sensor and one or more relationships, wherein each of the one or more relationships relates to a predefined range of coil temperature values.

19. A controller for a building refrigeration system comprising;

a compressor, an outdoor coil, an electronic expansion valve, a coil temperature sensor configured to measure a coil temperature of the outdoor coil, and an ambient temperature sensor configured to measure an ambient temperature;

wherein the controller comprises a processing circuit configured to:

execute a control algorithm to operate the building refrigeration system to heat a building;

record a speed of the compressor, an opening setpoint of the electronic expansion valve, and an execution location obtains from the control algorithm before performing a sacrificial defrost cycle;

cause the building refrigeration system to perform the sacrificial defrost cycle and cause the compressor to operate at a predefined compressor speed other than the recorded speed of the compressor and cause the electronic expansion valve to operate at a predefined electronic expansion valve opening setpoint other than the recorded electronic expansion valve opening setpoint;

cause the compressor to operate at the recorded speed of the compressor and cause the electronic expansion valve to operate at the recorded electronic expansion valve opening setpoint in response to an ending of the sacrificial defrost cycle;

record the measured coil temperature measured by the coil temperature sensor and the measured ambient temperature measured by the ambient temperature sensor;

execute the control algorithm at the recorded execution location obtains from the control algorithm in response to the ending of the sacrificial defrost cycle;

determine a temperature dependent variable (TDV) based on the measured coil temperature measured by the coil temperature sensor and one or more relationships between the TDV and the measured coil temperature measured by the coil temperature sensor, wherein each of the one or more relationships relates to a predefined range of coil temperature values;

determine a frost free curve (FFC) based on the recorded ambient temperature, a difference between the recorded ambient temperature and the recorded coil temperature, and the measured ambient temperature measured by the ambient temperature sensor; and determine a defrost active variable (DAV) based on the TDV and the FFC; and cause the building refrigeration system to perform a defrost cycle in response to determining that a second difference between the measured ambient temperature measured by the ambient temperature sensor and the measured coil temperature measured by the coil temperature sensor is greater than the DAV.

20. The controller of claim 19, wherein the processing circuit is configured to cause the building refrigeration system to perform another sacrificial defrost cycle in response to determining that the measured coil temperature measured by the coil temperature sensor is below a predefined coil temperature during the sacrificial defrost cycle.

* * * * *